US007097058B2

(12) United States Patent
Wellman et al.

(10) Patent No.: US 7,097,058 B2
(45) Date of Patent: Aug. 29, 2006

(54) CONTAINER AND LID COMBINATION WITH TAMPER EVIDENT INFORMATION

(75) Inventors: Craig Wellman, Milperra (AU); Victor Paul Ho, Ready Creek (AU)

(73) Assignee: Pathtainer Systems International Pty Ltd., North Sydney (AU)

( * ) Notice: Subject to any disclaimer, the term of this patent is extended or adjusted under 35 U.S.C. 154(b) by 0 days.

(21) Appl. No.: 11/108,096

(22) Filed: Apr. 15, 2005

(65) Prior Publication Data

US 2005/0173435 A1 Aug. 11, 2005

Related U.S. Application Data

(63) Continuation of application No. 10/111,560, filed as application No. PCT/AU00/01314 on Oct. 26, 2000, now abandoned.

(30) Foreign Application Priority Data

Oct. 26, 1999 (AU) ..... PQ3643
Mar. 7, 2000 (AU) ..... 20701/00

(51) Int. Cl.
*B65D 41/36* (2006.01)
*B65D 55/02* (2006.01)
*B65D 41/06* (2006.01)

(52) U.S. Cl. ..... 215/330; 215/217; 215/222; 215/252; 215/332; 215/901; 220/298; 220/300

(58) Field of Classification Search ..... 215/230, 215/216, 222, 252, 330, 331, 901, 217, 332; 220/300, 298
See application file for complete search history.

(56) References Cited

U.S. PATENT DOCUMENTS 2,133,490 A * 10/1938 Frederick ..... 215/252
2,414,420 A * 1/1947 Sebell ..... 215/252
3,917,097 A * 11/1975 Uhlig ..... 215/216
4,456,136 A * 6/1984 Palsson ..... 215/216
4,934,556 A * 6/1990 Kleissendorf ..... 220/269
4,993,570 A * 2/1991 Julian et al. ..... 215/252
5,160,057 A * 11/1992 Fitjer ..... 215/44
5,511,677 A * 4/1996 Oder ..... 215/252
5,671,853 A * 9/1997 Herr ..... 215/216
5,678,925 A * 10/1997 Garmaise et al. ..... 374/157
5,687,863 A * 11/1997 Kusz ..... 215/216
5,699,922 A * 12/1997 Harding ..... 215/208
5,865,330 A * 2/1999 Buono ..... 215/216
5,893,475 A * 4/1999 May ..... 215/252
5,915,579 A * 6/1999 Przytulla et al. ..... 215/252
5,918,752 A * 7/1999 Meyer ..... 215/204
5,988,412 A * 11/1999 Minnette et al. ..... 215/216

(Continued)

FOREIGN PATENT DOCUMENTS

FR 2532625 A * 3/1984

(Continued)

*Primary Examiner*—Nathan J. Newhouse
*Assistant Examiner*—Niki M. Eloshway
(74) *Attorney, Agent, or Firm*—Olson & Hierl, Ltd.

(57) ABSTRACT

A container (10) has a lid (12) for rotation mounting thereon. A tamper evident mechanism is located for operation between the container and lid. The mechanism includes at least one projection (42) on the container and at least one corresponding flange (44) on the lid. Each flange and projection pair is arranged such that, when the lid is rotation mounted on the container, the flange moves relatively past the projection to a position such that removal of the lid by counter rotation may only occur by deforming or breaking of the flange and/or projection.

24 Claims, 10 Drawing Sheets

U.S. PATENT DOCUMENTS 6,000,568 A * 12/1999 Verter ..... 215/252
6,024,235 A * 2/2000 Schwab ..... 215/247
6,047,840 A * 4/2000 Moore et al. ..... 215/330
6,065,603 A * 5/2000 Filice et al. ..... 206/519
6,375,028 B1 * 4/2002 Smith ..... 220/258.1
6,640,987 B1 * 11/2003 Vassallo ..... 215/216

FOREIGN PATENT DOCUMENTS

GB 2225778 A * 6/1990
GB 2277320 A * 10/1994

* cited by examiner

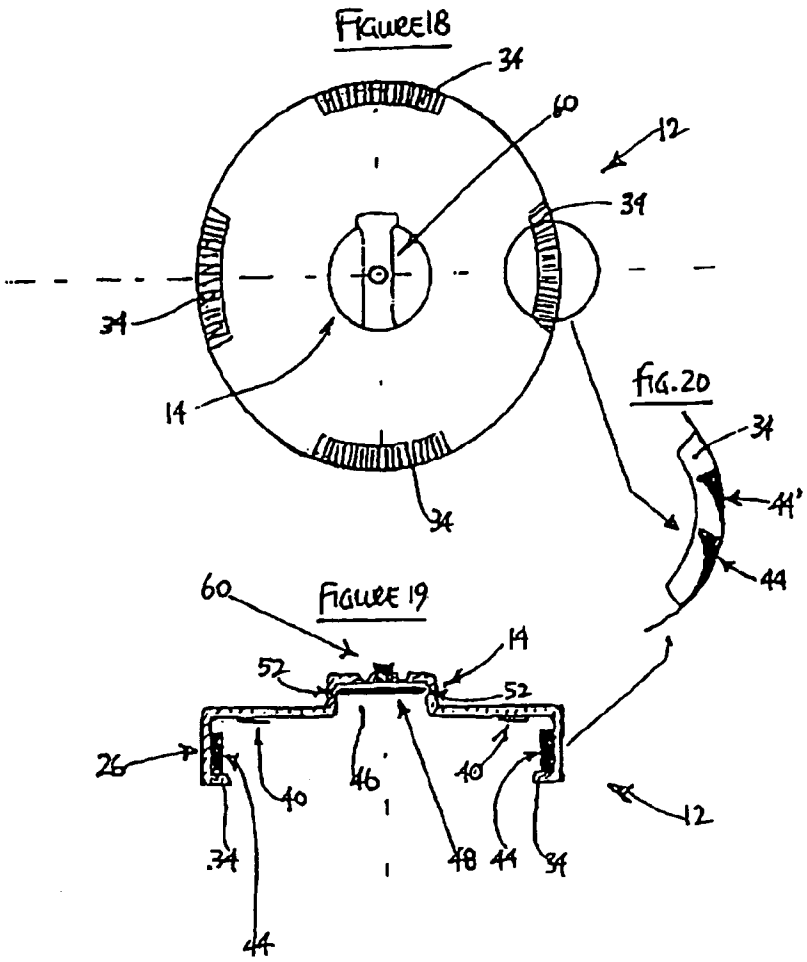
FIGURE 18
FIG. 20
FIGURE 19
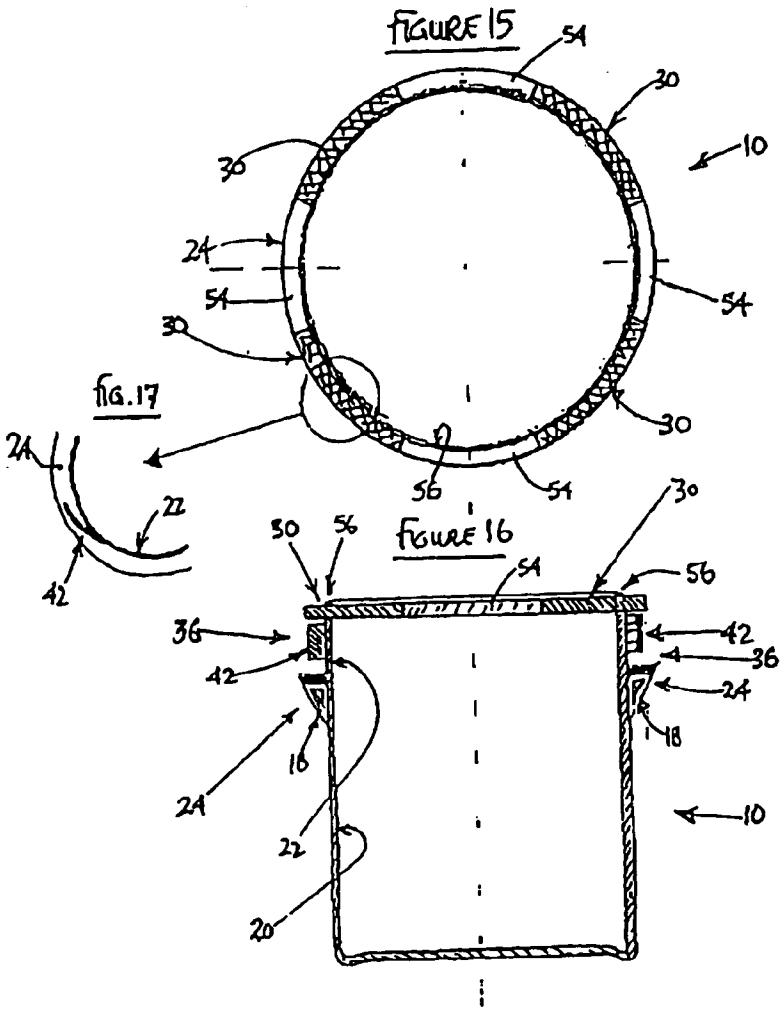
FIGURE 15
FIG. 17
FIGURE 16

CONTAINER AND LID COMBINATION WITH TAMPER EVIDENT INFORMATION

RELATED APPLICATION

The present application is a continuation of prior application Ser. No. 10/111,560, filed Aug. 19, 2002 now abandoned, which is the PCT National Phase stage of International Application No. PCT/AU00/01314, filed Oct. 26, 2000 and entitled "Container and Lid Combination with Tamper Evident Mechanism".

FIELD OF THE INVENTION

The present invention relates to a container having a lid for rotation mounting thereon, in particular a container and lid combination having a tamper evident mechanism which is located for operation between the container and lid. In addition, the lid itself may be provided with a separate tamper evident closure mechanism. The invention finds application in a wide variety of applications, wherever the contents of the container need to be provided intact/unadulterated to an end user. For example, where the contents are foodstuffs for consumption by a human or animal etc, or where the contents are medical samples from a human or other animal. The tamper evident mechanism may be further modified to instead provide a child-proof/child resistant closing mechanism.

BACKGROUND TO THE INVENTION

It is known in the art to provide tamper evident mechanisms between a container and an associated lid. For example, for variously comestible liquids such as water, juices, soft drinks etc, lids are provided with a frangible lower ring which typically may remain on the container as the lid is unscrewed. The severing of the ring from the lid at opening only then indicates to a user that the contents of the container have remained unaccessed since production by the manufacturer.

In medical applications, it is often critical that the samples of exudate (whether liquid or solid) taken from a user remain unaccessed until tested (eg. by a pathologist etc).

For example, a common method of testing for substance abuse is to collect samples of urine or other bodily fluids and to analyse the specimens for traces of predetermined substances. The sample may then be collected by the testing authority for later analysis.

Many techniques have been developed by dishonest persons, however, for accessing container contents without destroying or damaging tamper evident seals, thus allowing for swapping or adulteration of container contents.

It would be advantageous if at least an alternative tamper evident container could be provided for use in these various fields.

SUMMARY OF THE INVENTION

In a first aspect the present invention provides a container having a lid for mounting thereon, with a tamper evident mechanism located for operation between the container and lid, the mechanism including at least one flange on either the container or lid and at least one corresponding projection on either the lid or container respectively, the flange and projection being arranged such that, when the lid is rotation mounted on the container, the flange moves relatively past the projection to a position such that removal of the lid by counter rotation may only occur by deforming or breaking of the flange and/or projection.

Preferably, the deforming or breaking of the flange and/or projection would be detectable by a user.

By providing a tamper evident mechanism that is configured in the manner described above, the mechanism can be arranged to be less accessible by a user, thereby making it less easy for a lid to be removed and replaced whilst maintaining the tamper mechanism intact.

With the first aspect, the tamper evident mechanism employed may be the flange and projection arrangement as defined, but other tamper evident mechanisms can be employed such as a bridging adhesive between the container and lid which changes configuration or constitution etc when sheared, or another detection mechanism such as interconnecting webs etc. It is preferred that the projection is at least one finger projecting out from an upper external surface of the container and the flange is at least one shoulder projecting inwardly from a downwardly extending peripheral skirt of the lid, the finger and shoulder coming into engagement when the skirt is positioned over and around the upper surface of the container and the lid is rotated thereon. Alternatively, the projection (eg a finger) can be provided on the lid and the flange (eg a shoulder) can be provided on the container.

Preferably three fingers and three corresponding shoulders are spaced equidistantly around the container upper surface and skirt inner surface respectively. The equidistant configuration makes for ease of use and manufacture of both the container and lid.

Preferably the projection and flange are positioned in proximity to a bayonet coupling mechanism for operation between the lid and the container to fasten the same together (eg to lock the lid to the container). Preferably a stop is positioned at one end of the bayonet coupling mechanism for delimiting the rotation of the lid during mounting on the container. The stop can be positioned in such a way that it only allows for lid rotation, immediately after mounting the lid to the container, in one direction. In this regard, the stop can also prevent the rotation of the lid in an opposite direction by abutting a protrusion on the lid.

Preferably the delimiting location of the stop corresponds to a position in which the flange has moved past the projection.

The bayonet coupling mechanism preferably includes at least one element (eg. the protrusion referred to above) extending inwardly from the skirt of the lid and at least one formation located at the upper external surface of the container and defining a recess into which the element moves when the lid is rotation mounted to the container, the bayonet coupling mechanism enabling fastening of the lid to the container (eg. to lock it thereto). In this regard, it is preferred that the recess is tapered to cause a progressive increase in interference (ie. frictional engagement) as the element is progressively advanced thereinto. Thus, the bayonet mechanism can provide an increasing tightness of fit as the lid is rotated. This can enhance sealing between the lid and container (especially when seals are employed—as described below).

Again, it is preferred that three elements and three corresponding formations are spaced equidistantly around the container upper surface and the skirt inner surface respectively. Furthermore, it is preferred that each of the three fingers are located on the container upper surface above and aligned with a respective formation, and each of the three shoulders are located on the skirt above and aligned with a respective element. Again this enhances the ease of manufacture and use of the device.

Preferably the stop is defined by a closed end of the or each recess in the or each formation, such that eventually each element abuts a respective stop to delimit the rotation of the lid on the container.

In a further enhancement for preventing access to the tamper evident mechanism, it is preferred that a circumferential externally projecting barrier flange is provided around the side wall(s) of the container near to an upper end thereof, the barrier flange preferably being located such that the lid skirt can extend downwardly thereto (typically in a close facing arrangement) to prevent access to the or each projection and flange pair (or any other tamper evident mechanism mounted therewithin, between the lid and container).

Preferably during mounting of the lid to the container the or each element abuts and then travels on (slides along) an upper surface of the barrier flange (ie. when the lid is rotated on the container). The upper surface preferably combines with the or each formation to define the bayonet recess into which the respective element is moved. Thus, the barrier flange also typically provides a guiding surface for the lid during mounting.

Preferably the stop is a part of the formation and projects upwardly from the barrier flange upper surface (typically being integral therewith—eg. integrally moulded therewith).

Preferably an underside of the lid and/or an upper end of the container is provided with a sealing means which is engaged when the lid is mounted on the container to seal an opening thereat to the container. This engagement is typically facilitated by the tapered recess in the or each formation; ie. as the lid is progressively rotated, the sealing means is progressively engaged, thus increasing the seal at the opening.

Preferably, the sealing means is one or more circumferential sealing rings projecting out from an end of the container, or from an underside of the lid, or is one or more gaskets located on the container end or lid underside.

Preferably, the container is nestable, having a base and sidewalls diverging upwardly and outwardly from the base to define an open top.

Preferably, the lid includes an upper portion hingedly connected to a lower portion, the upper portion being movable between an open position and a closed position.

Also preferably, the lower portion of the lid includes a peel away cover portion which, when peeled away, provides access to the container when the lid is mounted thereto, the cover portion being covered by the upper portion when in the closed position.

Also preferably, the upper portion of the lid sealingly engages with the lower portion when in the closed position.

In another aspect the present invention provides a lid for mounting on a container, the lid having a projection with a closure mounted at the projection to cover an opening to a passage through the projection. In other words, the lid itself may be provided with a further opening having the closure mounted thereat.

Preferably a sealing element is located under the closure for closing the passage to fluid flow (eg. both gas and liquid flow). Preferably the closure itself is tamper evident, and the projection is typically formed to be upstanding from the lid (although in some situations may also project downwardly from the lid (ie. towards and/or into the container)).

Typically the sealing element is located within the passage, and this has particular advantage, in that the seal is wholly contained within the lid itself, thus making further access difficult. In this regard, the seal element can be mounted to sit within an annular undercut defined at an inner wall of the passage; and/or may be adhesively fastened at its periphery to an inner wall of the passage (or adhesively fastened at an inward peripheral projection therefrom). Typically the sealing element is a flexible polymeric disc, such that it can be easily formed and inserted in the passage, but more preferably such that the needle of a syringe can be inserted therethrough, so that contents within the container can be extracted, and such that after removal of the needle, the seal element continues to provide a sealing function.

Preferably the projection is centrally located in the lid for ease of manufacture and use.

Typically the closure is a ring pull formation including a tab defined within the closure that has frangible sideline(s) extending from a non-frangible hinge to the closure, with the ring connected to the tab, and such that pulling on the ring at a predetermined force causes the frangible sideline(s) to break, thus exposing the passage.

The lid of this other aspect may additionally incorporate the features of the lid, and be used in conjunction with the container, as defined in the first aspect.

In a further aspect the invention provides a lid for mounting on a container, the lid including an upper portion connectable to a lower portion, in a manner that closes an opening in the lower portion to the container.

Preferably, the upper portion is hingedly connected to a lower portion, the upper portion being movable between an open position and a closed position in which the upper portion closes the opening. Also preferably, the lower portion includes a peel away cover at the opening which, when peeled away, provides access to the container via the opening. Also preferably the upper portion sealingly engages with the lower portion around the opening when in the closed position.

In an alternate embodiment of the invention, the container includes temperature indicating patches located on a sidewall of the container.

Preferably, the lid further includes a septum permitting the addition or removal of the contents of the container by hypodermic syringe.

Also preferably, the container includes a diagnostic test strip within the container for detecting predetermined substances.

BRIEF DESCRIPTION OF THE DRAWINGS

Notwithstanding any other forms which may fall within the scope of the present invention, preferred forms of the invention will now be described, by way of example only, with reference to the accompanying drawings in which:

FIGS. 15 and 16 show, respectively, plan and side sectional elevations of an alternative container in accordance with the present invention, with FIG. 17 showing schematically a partial detail of FIG. 15;

FIGS. 18 and 19 show, respectively, plan and side sectional elevations of an alternative lid in accordance with the present invention, with FIG. 20 showing schematically a partial detail of FIG. 18;

MODES FOR CARRYING OUT THE INVENTION

Figure 4:
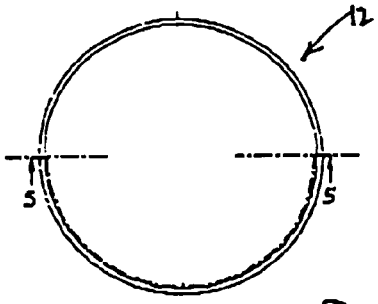
FIGS. 4 to 6 show similar views to FIGS. 1 to 3, but with a modified lid.
Figure 1:
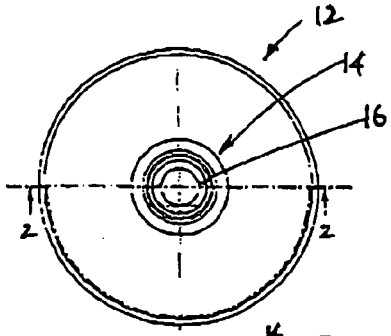
FIGS. 1 to 3 show, respectively, plan, side (partly sectioned on the line 2—2), and underside plan elevations of a preferred container and lid in accordance with the present invention.
Figure 5:
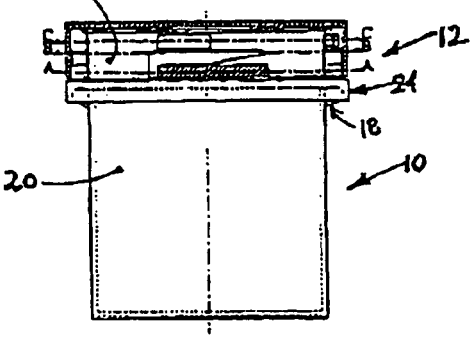
Figure 2:
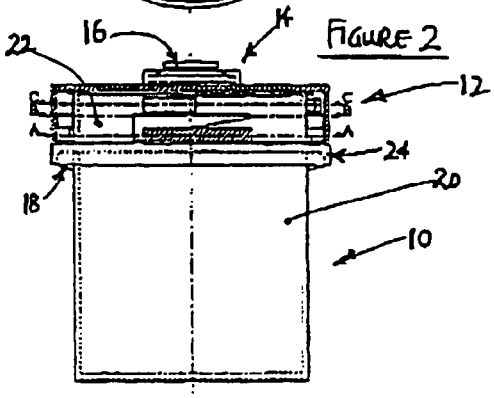

Referring to FIGS. 1 to 3 and FIGS. 4 to 6, where like reference numerals will be used to denote similar or like parts, a container and lid in accordance with the present invention are shown in the form of jar 10 and cap 12. The cap of FIGS. 1 and 2 is different to that of FIGS. 4 and 5 in that it is provided with an additional opening at boss 14, which is covered by a closure 16 and which may for example be a ring pull closure mechanism or a peel back adhesive cover etc.

Figure 6:
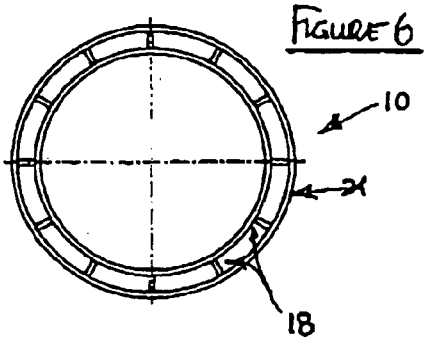
Figure 3:
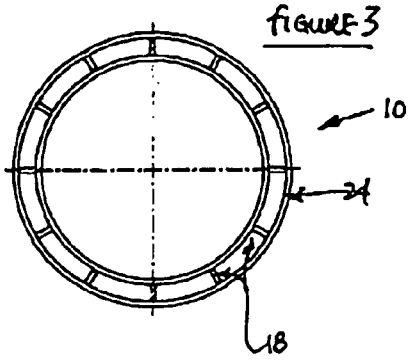

Jar 10 has a lower wall section 20, which is separated from an upper wall section 22 by a circumferential barrier flange 24. As can be seen in FIGS. 3 and 6, the underside of the barrier flange is reinforced around its circumference by webs 18.

Figure 7:
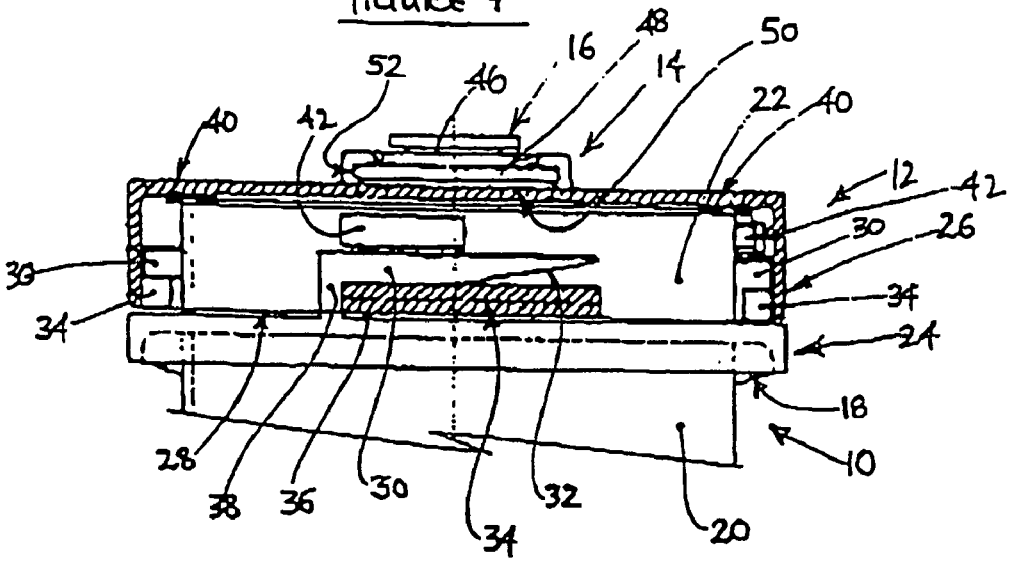
FIGS. 7 and 8 show, respectively, enlarged partial views of FIGS. 2 and 5.
Figure 8:
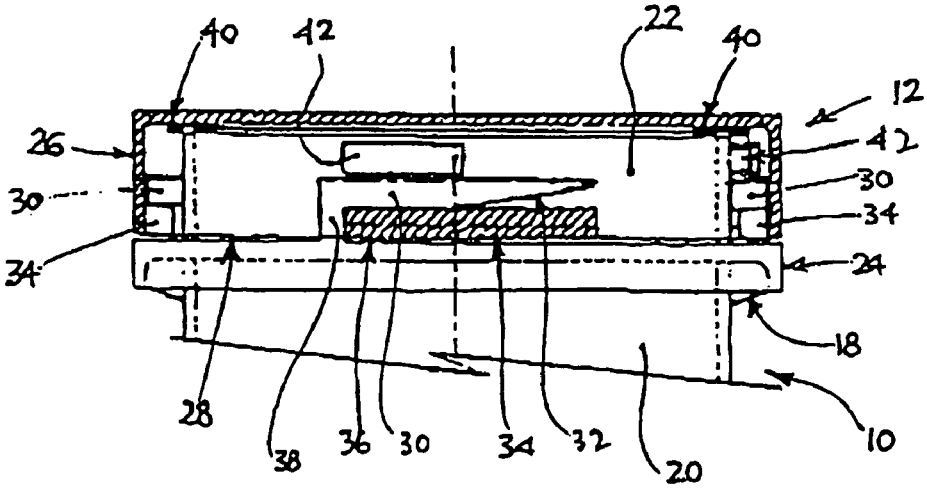

Referring now to FIGS. 7 and 8, the mounting of the cap 12 to jar 10 will be described in greater detail, including the tamper evident mechanism positioned therebetween. Again, like reference numerals will be used to denote similar or like parts.

The barrier flange 24 provides a surface against which the cap can be sealed, and combines with a skirt 26 of the cap (ie. at cap lower edge 28 to enclose the tamper evident mechanism (as described below)).

Formed integrally with and projecting up from flange 24 is bayonet guide element 30. The guide element has a taper 32 which is oriented to guide an inwardly projecting lug 34 of cap 12 into the space between the element and flange 24. In other words, the guide element 30 in conjunction with flange 24 defines a recess 36 into which the lug 34 can be moved (ie. when the cap 12 is rotated on jar 10). The guide element is connected to flange 24 via web 38, which closes off the end of recess 36 and provides a stop against further lug movement in recess 36 (thus stopping cap rotation). In addition, the web 38 can (on its other side) prevent counter rotation of the cap 12 on jar 10 (ie. during mounting of the cap to jar 10).

It will be seen more clearly (with reference to FIGS. 9 to 14) that three such guide elements 30 and lug arrangements 34 are spaced evenly (equidistantly) around the jar and cap respectively. Thus, the interaction of the multiple guide elements and lugs provides a bayonet fitting for easily attaching the cap 12 to jar 10. In addition, the tapered arrangement enables the cap to have its rotation mounting fitting to the jar progressively tightened.

To facilitate sealing of the opening to the jar 10, a circumferential gasket 40 is affixed (eg. adhesively or press fitted into undercuts etc) to the underside of cap 12. The gasket aligns with the wall of upper wall section 22, and is compressed thereby when the cap is rotated into the position of FIG. 7.

Extending out from (typically moulded integrally therewith) upper wall section 22 of jar 10 are a plurality of (typically three) spring fingers 42. Two such fingers are shown in FIGS. 7 and 8. The spring fingers are flexible and are adapted for interacting with inwardly projecting shoulders 44 (FIGS. 9*c* and 12*c*) of the cap 12. During rotation of the cap 12 to attach it to jar 10, the shoulders 44 travel past the spring fingers 42, and the spring fingers are deflected inwardly thereby. After the shoulders have travelled past the fingers, the fingers spring back, such that the free end of each spring finger then sits behind a respective shoulder. The arrangement is configured such that the cap cannot then be unscrewed from its mounting to the jar without either deforming or breaking either the fingers or the shoulder or both.

This constitutes both a form of tamper evident mechanism and a locking mechanism. Further a user can immediately detect whether or not the cap has been detached from the jar by checking the state of the spring fingers and the shoulders. Typically both are formed from a deformable plastic which records (either through permanent deformation or breakage) that the "seal" has been broken. Other similar mechanisms can be employed, including the provision of an adhesive which is located in place prior to screw tightening of the cap on the jar, or an adhesive which is released and bridges between the cap and jar upon the first screwing of the cap onto the jar etc. The fingers can, alternatively, be provided on the cap and the shoulders on the jar. As a further alternative a series of internal webs extending between the cap and jar can be employed. Also, many finger/shoulder configurations are possible, for example, by providing a pair of opposing fingers or a pair of opposing shoulders (ie. one each on the cap and jar respectively) etc.

FIG. 7 also shows the cap having integral boss 14, typically being a projection that is moulded integrally with the cap during its manufacture. Closure 16 covers the boss at a passage 46 which extends right through the cap.

Once the closure 16 is removed, the contents of the jar would normally be open to pour or flow thereout via passage 46. If this is not desired, then a membrane 48 (eg. a polymeric membrane or a natural or synthetic rubber) can be positioned within boss 14 to seal the passage. The membrane can also be positioned in alignment with the cap upper surface at location 50. Undercuts 52 for retaining the membrane in position can also be provided (ie. so that the membrane is in effect snap locked into position). Additionally, the membrane can be adhesively bonded to the interior wall of boss 14, or to an annular projection extending out therefrom.

An advantage of using a membrane, particularly in medical situations, is that instruments such as needle syringes, pippettes etc can be inserted therethrough to extract sample held within the jar, and can then be withdrawn from the membrane. The membrane, being resilient, closes back up to re-seal the passage against liquid and fluid flow thereacross.

The arrangement in FIG. 8 is identical to that in FIG. 7 except that no boss/enclosure arrangement 14,16 is provided.

Figures 9, 10, 11:
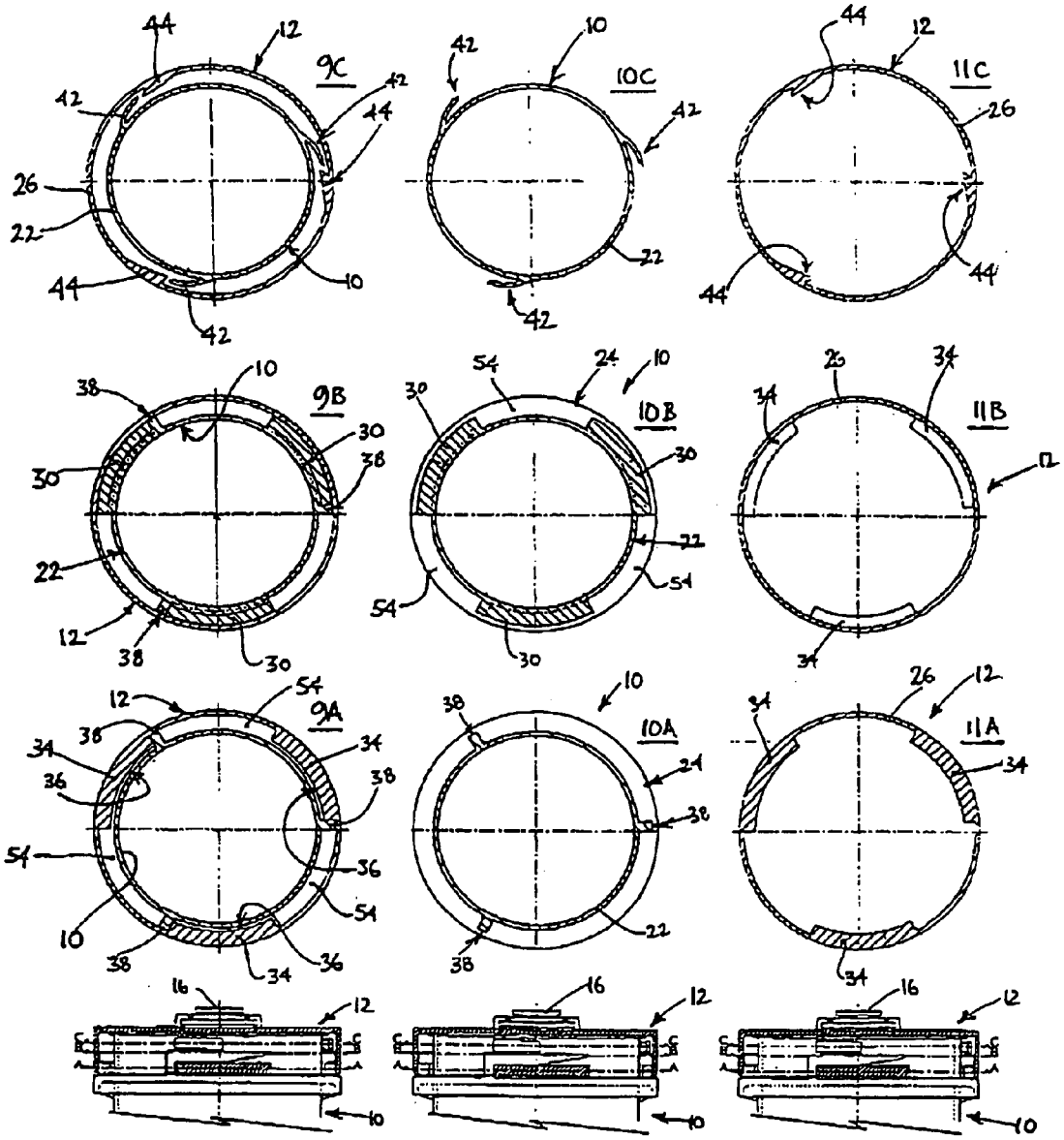
FIG. 9 shows an identical view to FIG. 7, but FIGS. 9*a*, 9*b* and 9*c* show, respectively, slices of the container and lid together taken on the lines AA, BB and CC of FIG. 9.
FIG. 10 again shows an identical view to FIG. 7, but FIGS. 10*a*, 10*b* and 10*c* show, respectively, slices of the container only taken on the lines AA, BB and CC of FIG. 10.
FIG. 11 again shows an identical view to FIG. 7, but FIGS. 11*a*, 11*b* and 11*c* show, respectively, slices of the lid only taken on the lines AA, BB and CC of FIG. 11.

Referring now to FIGS. 9 to 11, firstly, FIG. 9 shows a jar and cap assembly identical to that shown in FIG. 7. FIG. 9*a* shows a schematic view (slice) of that assembly taken on the line AA of FIG. 9. The same cap position is shown in views 9 to 9*c*, wherein the cap 12 has been screwed onto jar 10 so that each lug 34 has passed into its respective recess 36 until it abuts web 38 (which acts as a stop against further rotation). In so doing, the lug has previously moved from a respective space 54, being that space above the cap barrier flange 12 between the other side of web 38 and the opening to recess 36 (ie. at the front open end of the bayonet guide element 30). These spaces 54 enable the cap to be fitted (pushed down on) to the jar, the cap in effect being moved down so that the lugs 34 pass into their respective spaces 54, and the cap then being rotated so that the lugs pass into recesses 36 guided by taper 32 on the bayonet guide element 30. A user can push down against the gasket 40 to further enhance sealing.

FIG. 9*b* shows each web 38 and its associated guide element 30, protruding out from the upper wall section 22 of the jar 10. FIG. 9*c* shows the three spring fingers 42 protruding out from upper wall section 22 of cap 12 and the three corresponding shoulders 44 projecting inwardly from the skirt 26 of cap 12. Thus, the webs 36 are positioned such that, when the cap is rotated to move the lugs into recesses 36 to abut webs 38, the spring fingers travel over their respective shoulders and then snap back into position behind each respective shoulder to in effect "lock" the cap to the jar. As indicated above, various protuberances, projections, flanges etc can be used to effect the interaction (and provide tamper evidence) between the jar and cap, including pairs of opposing fingers, pairs of opposing flanges etc.

Referring to FIGS. 10 to 10*c*, various sectional views (slices) through the jar only are depicted. FIG. 10*a* clearly depicts the three evenly spaced webs 38 projecting out from the upper wall section 22 of jar 10. FIG. 10*b* shows the three evenly spaced bayonet guide elements 30 projecting out from the upper wall section 22 of jar 10, and FIG. 10*c* shows the three evenly spaced spring fingers 42 projecting outwardly from the wall section 22 of jar 10.

Referring now to FIGS. 11 to 11*c*, various sectional views (slices) through cap 12 will now be described. In FIG. 11*a*, the slice is taken through the middle of the three lugs 34 which project inwardly from skirt 26 of cap 12. FIG. 11*b* shows a similar view to FIG. 11*a*, but in this case the slice is through cap 12 above lugs 34. FIG. 11*c* is a slice through cap 12 through the middle of shoulders 44, illustrating clearly how the shoulders project inwardly from the cap skirt 26.

Figures 12, 13, 14:
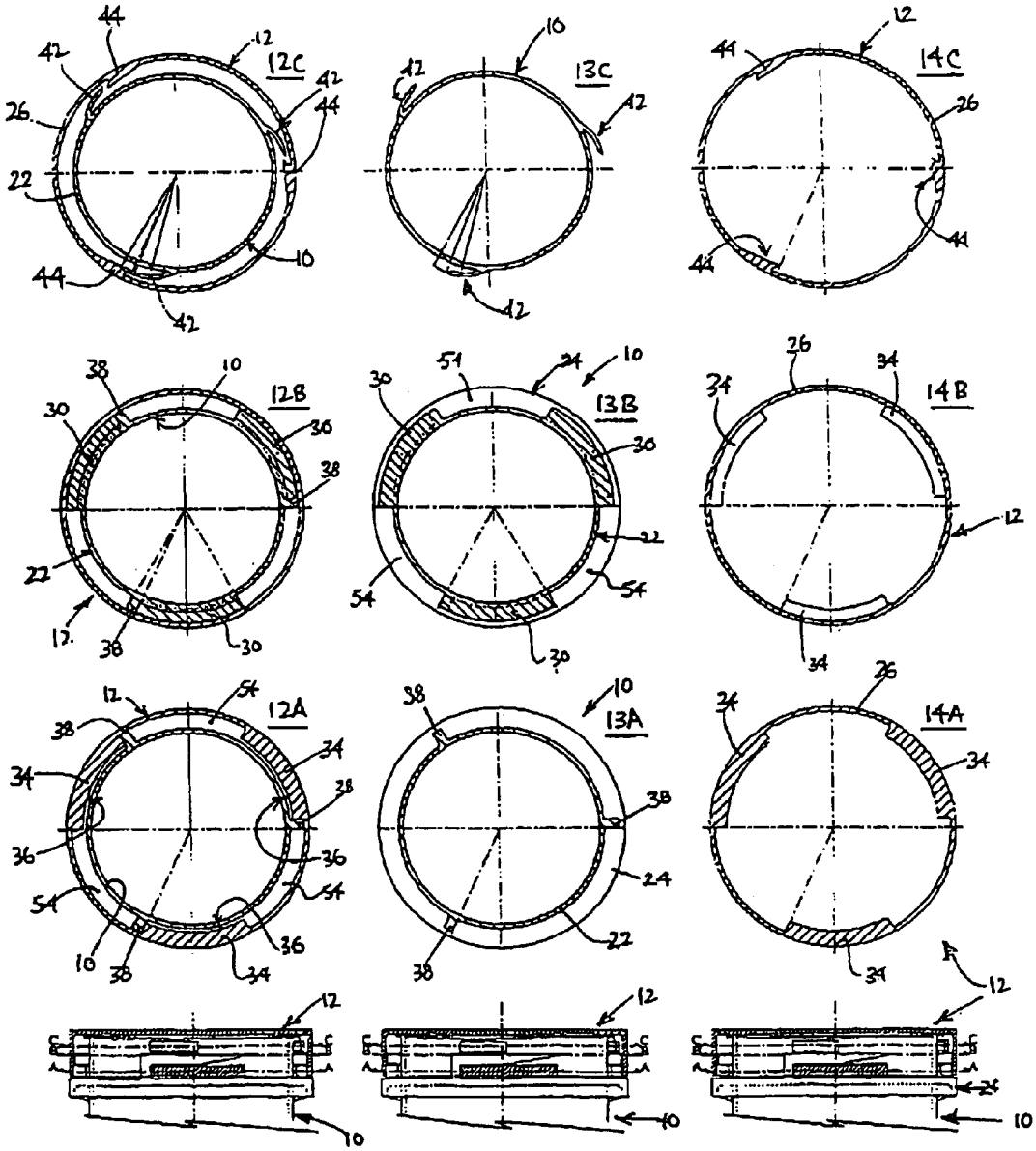
FIG. 12 shows an identical view to FIG. 8, but FIGS. 12*a*, 12*b* and 12*c* show, respectively slices of the container and lid together taken on the lines AA, BB and CC of FIG. 12.
FIG. 13 again shows an identical view to FIG. 8, but FIGS. 13*a*, 13*b* and 13*c* show, respectively, slices of the container only taken on the lines AA, BB and CC of FIG. 13.
FIG. 14 again shows an identical view to FIG. 8, but FIGS. 14*a*, 14*b* and 14*c* show, respectively, slices of the lid only taken on the lines AA, BB and CC of FIG. 14.
Figure 21:
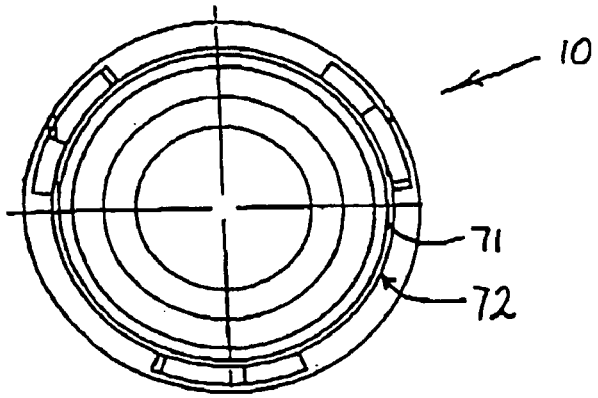
FIGS. 21 to 23 show, respectively, plan, side, and underside plan elevations of an alternate container in accordance with the present invention.

FIGS. 12 to 14 show virtually identical views to those of FIGS. 9 to 11 absent boss 14 and enclosure 16 (ie FIGS. 12, 13 and 14 show the jar and cap arrangement of FIG. 8). Thus, these Figures will not be described again. FIGS. 12*a* through to 14*c* also depict, by way of imaginary angle lines, how the bayonet guide elements 30, lugs 34, spring fingers 42 and shoulders 44 are all aligned within the jar and cap, highlighting the symmetry of the preferred jar and cap arrangement, and thus its ease of manufacture and use. Like reference numerals are otherwise used to denote similar or like parts.

Referring now to FIGS. 15 to 20, again where like reference numerals are used to denote similar or like parts, an alternative cap and jar arrangement is depicted. Referring firstly to FIGS. 15 to 17, the jar 10 has four bayonet guide elements 30 and four associated spring fingers (one way clips) 42. The spring fingers are shown in greater detail in FIG. 17. However, in the embodiment of FIGS. 15 and 16 the spring fingers 42 are provided within the bayonet recess 36 so that both the cap lugs 34 and the cap shoulders 44 (ie. see FIGS. 19 and 20) are rotated into recess 36 to lock the cap to the jar. The spring fingers 42 and shoulders 44 otherwise interact in a similar manner to that described above.

The recess 36 may again taper to cause progressive tightening in the fitting of the cap to the jar, and additionally a gasket seal 40 can be provided on the underside of the cap. However, the jar is additionally provided with an upstanding circumferential rim 56 which abuts the gasket and is tightened thereagainst as the cap is screw fitted onto the jar. The jar is in other respects similar to that shown in FIGS. 1 to 14.

Referring now more specifically to FIGS. 18 and 19, the closure 16 is shown in the form of a ring pull 60, the operation of which provides a direct indication of tampering. Specifically the ring pull can be biased upwardly to pull on a frangible tab, which pivots around a hinge. This exposes an opening to boss 14. The tab and ring pull may be subsequently entirely removed (if required). In so doing, the removal of the ring pull opens passage 46, again which is typically sealed by membrane 48. The undercuts 52 are once again used to hold the membrane in place.

FIG. 20 indicates that a double shoulder arrangement can be employed for each spring finger 42, thus providing two locking positions of the cap on jar 10. Typically rotation to the second locking position (ie. behind the second shoulder 44') provides a more permanent and fastened positioned and any unauthorised movement therefrom clearly indicates tampering. The operation of the jar and cap arrangement of FIGS. 15 to 20 is, however, in all other respects similar to that of FIGS. 1 to 14.

By providing suitable push buttons in alignment with the spring fingers around the circumference of the skirt 26 (or by even providing recesses in the skirt that open on to the fingers) the function of the container can be changed from that of a tamper evident container to that of a child resistant container. In other words, considerable dexterity would be required to press three or four spring fingers simultaneously, and thus the jar and cap arrangement modified in this manner could provide an excellent child resistant container for the storage of various dangerous or hazardous substances including medicines, cleaning chemicals, oils etc.

In FIGS. 21 to 30, like reference numerals are used to denote similar or like parts in comparison with the previously described embodiments.

Figure 22:
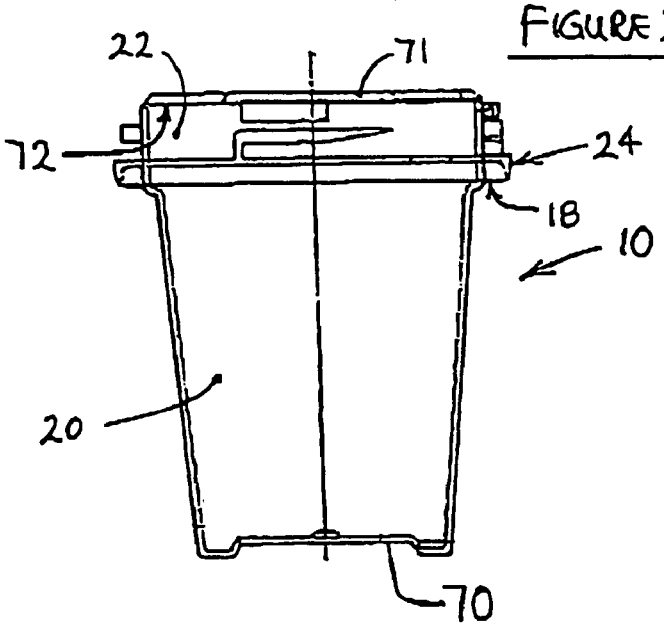
Figure 23:
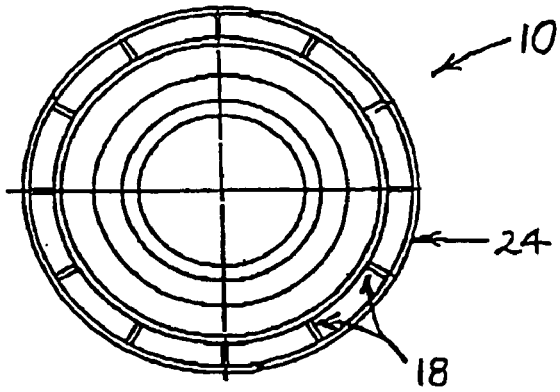
Figure 29:
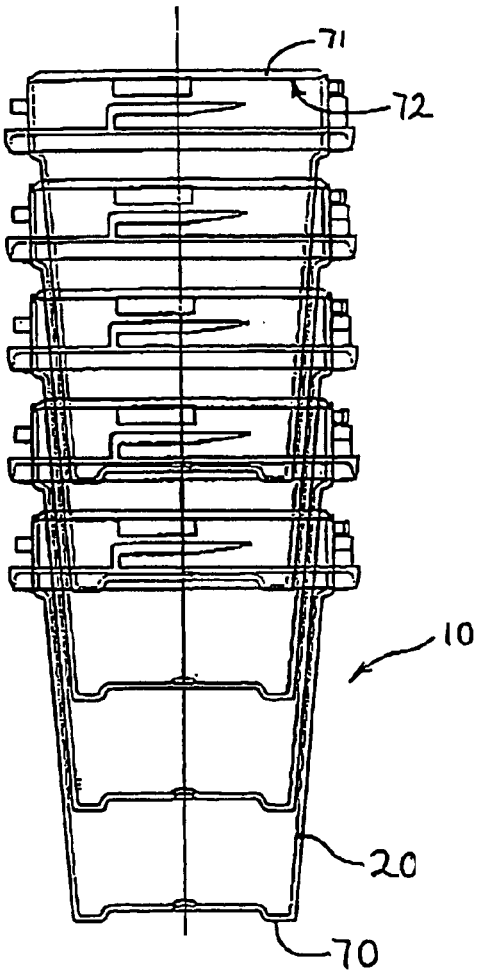
FIG. 29 shows a sectional side elevation of five containers of FIG. 22, in a nested formation.

The main difference between jar 10 of the previous embodiments and jar 10 of the embodiment shown in FIGS. 21 to 30, is best shown in FIGS. 22 and 29. As seen in FIG. 22, the lower wall section 20 of the jar 10 diverges upwardly and outwardly from its base 70. This allows multiple jars 10 to nest one inside the other as shown in FIG. 29. This nesting arrangement is ideal for storing and transporting the containers when not in use, reducing storage space required for multiple jars 10.

Also shown in FIGS. 22 and 29 is a sealing means in the form of a circumferential flange 71, which projects upwardly and inwardly from an end 72 of the jar 10. In use, the flange 71 is engaged by the cap 12 when the cap is rotation mounted on the jar 10 and is deformed thereby to provide a seal. As the cap 12 is progressively rotated, the flange 71 is forced against an underside of the cap 12 for increased/enhanced sealing engagement therewith. The flange 71 is typically flexible, to allow for ready deformation thereof when sealing against the cap 12.

Additionally, the sealing means includes a further flange projecting upwardly and outwardly from the end 72 of the jar, and being radially spaced from flange 71. Thus two concentric sealing flanges can be provided for an even greater degree of sealing.

Figure 24:
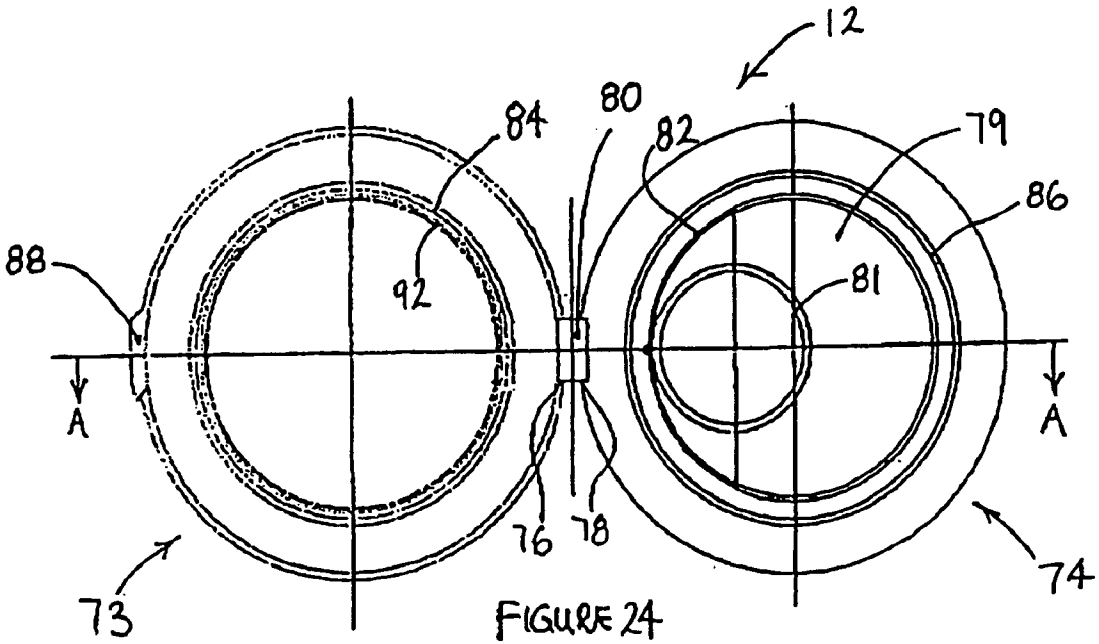
FIG. 24 shows a plan view of an alternate embodiment of a lid in accordance with the present invention.
Figure 25:
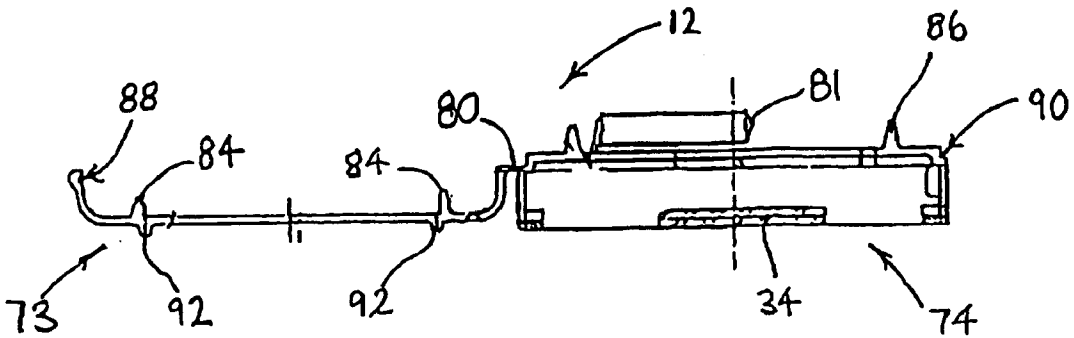
FIG. 25 shows a sectional side elevation taken on line AA of FIG. 24.
Figures 26, 27, 28:
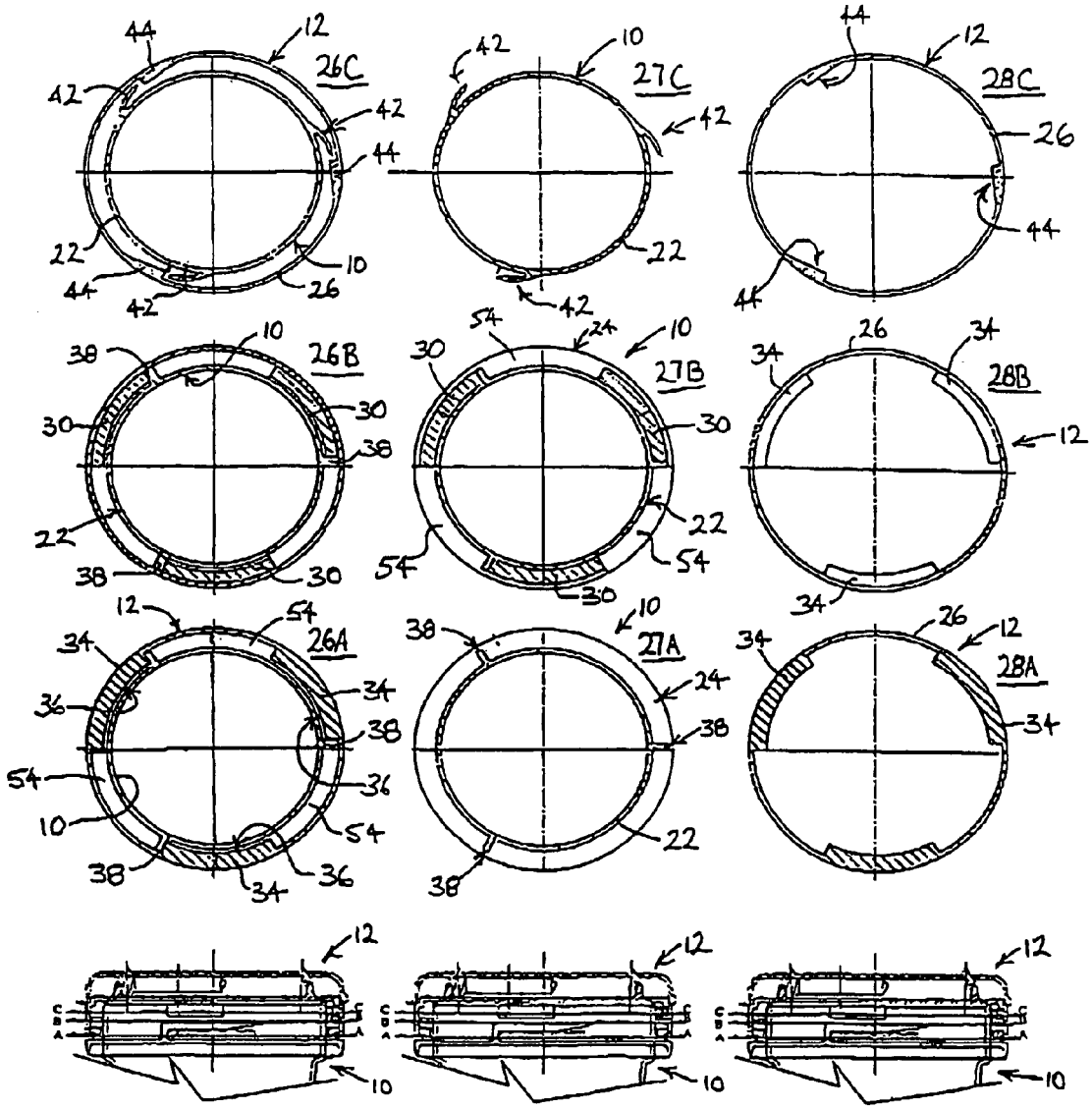
FIG. 26 shows an enlarged partial view of FIG. 22 including the lid of FIG. 24, but FIGS. 26*a*, 26*b* and 26*c* show, respectively slices of the container and lid together taken on the lines AA, BB and CC of FIG. 26.
FIG. 27 again shows an identical view to FIG. 22 including the lid of FIG. 24, but FIGS. 27*a*, 27*b* and 27*c* show, respectively, slices of the container only taken on the lines AA, BB and CC of FIG. 27.
FIG. 28 again shows an identical view to FIG. 22 including the lid of FIG. 24, but FIGS. 28*a*, 28*b* and 28*c* show, respectively, slices of the container only taken on the lines AA, BB and CC of FIG. 28.

FIGS. 24 and 25 shown an alternate embodiment of the cap 12. The cap 12 of this embodiment includes top 73 and bottom 74 portions connected on respective edge portions 76 and 78 by a hinge 80.

Bottom portion 74 also includes a peel away cover 79 and a ring pull 81 attached thereto, the ring pull 81 being adapted to allow a person's finger to at least partially pass therethrough. If the jar 10 and cap 12 contain a substance, and it is desired that the substance be at least partially removed from the jar 10, a user can manually engage the ring pull 81 and pull it. Once a predetermined force of pull is reached by the user, the peel away cover 79 will tear along frangible line 82. The user may tear the peel away cover 74 only partly or entirely along frangible line 82, exposing the contents of the jar 10.

Top portion 73 is movable about the hinge between open (FIGS. 24 and 25) and closed (FIG. 30) positions. Top portion 73 also includes an internal sealing ridge 84 which sealingly engages with corresponding sealing ridge 86 on bottom portion 74 when in the closed position. Additionally, top portion 73 has a clip latch 88 for snap-lockable engagement with a clip receiving portion 90 on the bottom portion 14, when the top portion 73 is in its closed position. Amongst other things, this, in conjunction with sealing ridge 84 and 86, allows jar 10 to be resealed when top portion 73 is in its closed position, should frangible line 82 have been broken.

A tamper evident mechanism may be provided between the top 73 and bottom 74 portions. For example, a mechanism can be provided at the latch 88, that is damaged after the first opening of the top portion 73 towards its open position.

Figure 30:
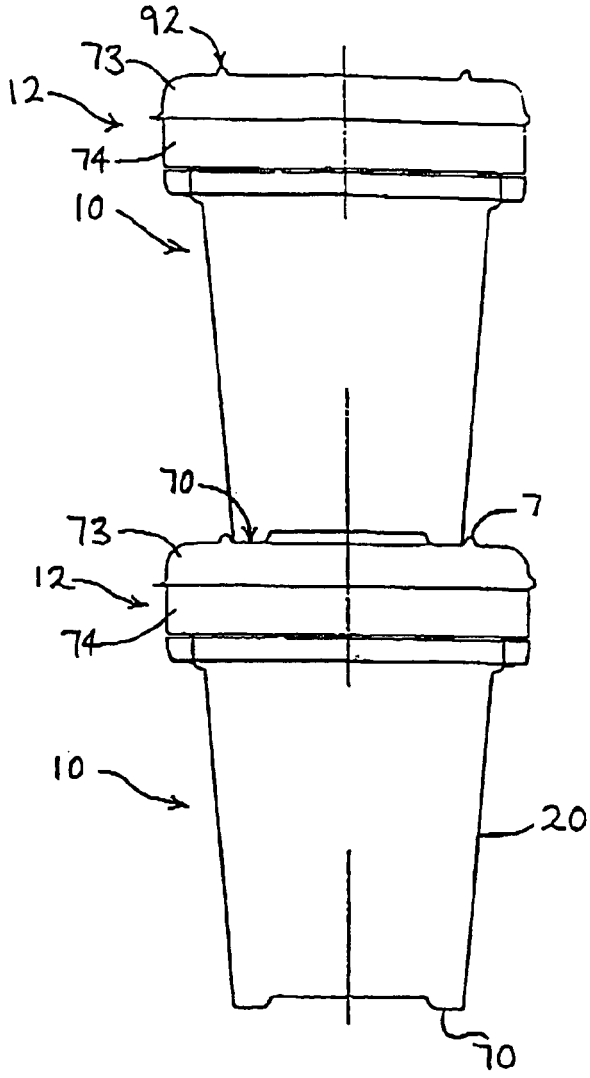
FIG. 30 shows a side elevation of two containers of FIG. 22 with lids of FIG. 24 fitted thereto, the containers being in a stacked position.

Top portion 73 also includes an externally projecting annular guide ridge 92. When the jar 10 and cap 12 are stacked one on top of the other, as shown in FIG. 30, the guide ridge 92 aids in stably seating the base 70 of an adjacent jar on the cap 12. This is particularly useful for transporting several jars at once when the cap 12 is closed on the jar 10.

Figure 31:
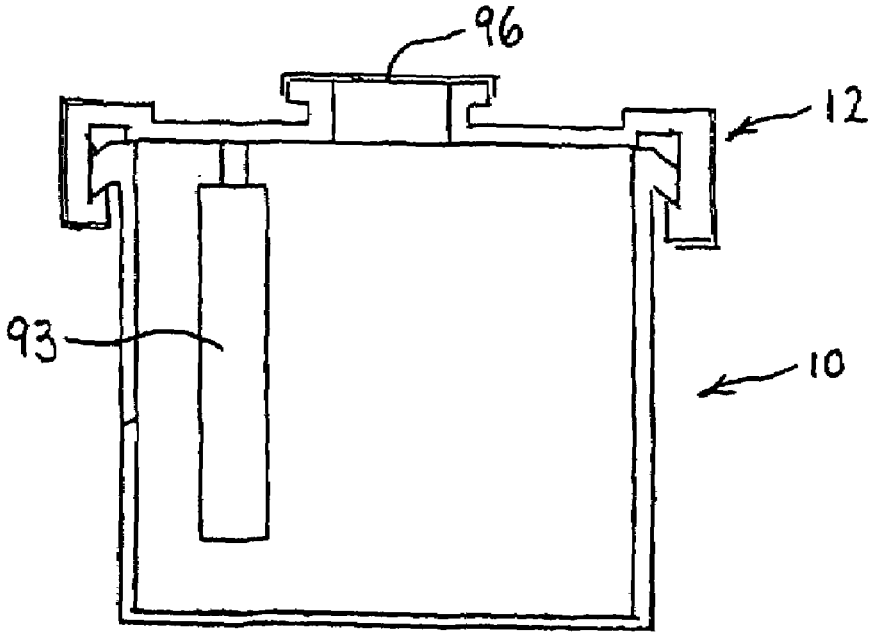
FIGS. 31 and 32 show, respectively, sectional side and side elevations of an alternate container in accordance with the present invention.

In a further alternate embodiment shown in FIG. 31, the cap 12 of the jar 10 may have suspended from it a diagnostic test strip 93 which changes colour or appearance in the presence of predetermined substances when the diagnostic testing strip is immersed in a collected specimen (eg urine or blood). The predetermined substances may be alcohol or performance enhancing drugs such as human growth hormone and steroidal substances such as mandrolone.

Figure 32:
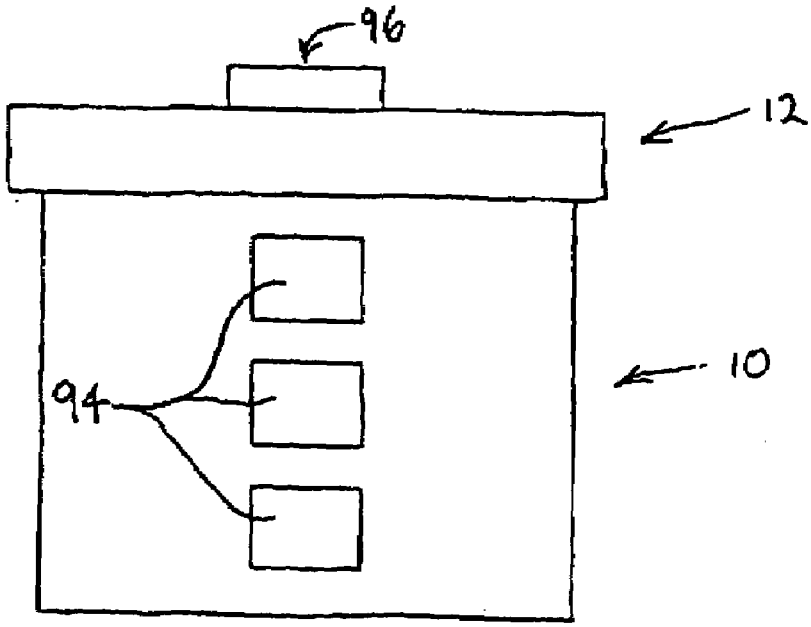

In another alternate embodiment of the invention shown in FIG. 32 temperature sensitive patches 94 may be fixed to the surface of the jar 10. These patches may be of the type which permanently change colour when the temperature exceeds a threshold slightly below normal body temperature or they may be of the type which only temporarily change colour at a predetermined temperature. In use these patches 94 can detect the addition of substances to, for example, a urine sample collected in the jar 10 where the temperature of the added substance is above or below a predetermined temperature. Typically the predetermined temperature would be the normal temperature of urine leaving the body. This would allow a collecting body to detect whether, for example, a urine sample had be diluted during collection, possibly by water or by another substance.

The cap 12 of embodiments shown in FIGS. 31 and 32 may also employ the use of a septum 96 to allow the introduction or withdrawal of substances collected in the jar 10 by a hypodermic syringe.

The container and lid can be provided in many shapes, sizes and materials. For example, the container may be in the form of a test tube. In conjunction with the lid, the test tube container and lid combination can provide more versatility in terms of providing tamper evident test tubes for pathological and scientific testing. Another example of container and lid shape includes take away food containers.

Containers encompassing the features of the present invention can be used in a multitude of applications examples of applications include forensic science; pathology; take away food; urine and other human or animal bodily fluid sample collection; veterinary applications; and so on. The container and lid of the present invention can therefore hold all manner of substances including liquids, solids and even gases.

Whilst the invention has been described with reference to a number of preferred embodiments, it should be appreciated that the invention can be embodied in many other forms.

The invention claimed is:

1. A container assembly having a container, and a lid for mounting on the container, with a tamper evident mechanism located for operation between the container and the lid, the lid having a lid skirt, the tamper evident mechanism including at least one flange on either the container or lid and at least one corresponding projection on either the lid or container, respectively, the container having a circumferential externally projecting barrier flange provided around a side wall of the container near to an upper end thereof and below the tamper evident mechanism, the barrier flange being located such that the lid skirt can extend downwardly thereto to prevent access to the tamper evident mechanism, the flange and projection being substantially covered by the lid and being arranged such that when the lid is rotation mounted on the container, the flange moves relatively past the projection to a position such that removal of the lid by counter rotation may only occur by deforming or breaking either one or both of the flange and the projection, the lid and barrier flange shielding the tamper evident mechanism to thereby restrict access to the tamper evident mechanism when the lid is mounted to the container, and the lid substantially covering the flange and the projection during said lid counter rotation so that the flange and the projection remain inaccessible to tampering.

2. The container assembly of claim 1 wherein the deforming or the breaking of either one or both of the flange and the projection is detectable by a user.

3. A container assembly of claim 1 wherein the projection is at least one finger projecting out from an external upper surface of the container and the flange is at least one shoulder projecting inwardly from the skirt of the lid, the finger and shoulder coming into engagement when the skirt is positioned over and around the upper surface of the container and the lid is rotated thereon, and wherein the projection and flange are positioned in proximity to a bayonet coupling mechanism for operation between the lid and container to fasten the same together.

4. The container assembly of claim 3 including three fingers and three corresponding shoulders.

5. The container assembly of claim 4 wherein the three fingers are located on the container upper surface above and aligned with a respective formation and each of the three shoulders are located on the skirt above and aligned with a respective element.

6. The container assembly of claim 3 including a stop positioned at one end of the bayonet coupling mechanism for delimiting the rotation of the lid during mounting on the container.

7. The container assembly of claim 6 wherein the delimiting location of the stop corresponds to a position in which the flange has moved past the projection.

8. The container assembly of claim 6 wherein the stop is defined by a closed end of a recess in a formation, such that an element eventually abuts a respective stop to delimit the rotation of the lid on the container.

9. The container assembly of claim 6 wherein the stop is part of the formation and projects upwardly from the barrier flange upper surface.

10. The container assembly of claim 9 wherein the barrier flange being located such that the lid skirt can extend downwardly thereto to prevent access to a projection and flange pair.

11. The container assembly of claim 3 wherein the bayonet coupling mechanism includes at least one element extending inwardly from the skirt of the lid and at least one formation located at the upper external surface of the container and defining a recess into which the element moves when the lid is rotation mounted to the container, the bayonet coupling mechanism enabling fastening of the lid to the container.

12. The container assembly of claim 11 wherein the recess is tapered to cause a progressive increase in interference as the element is moved progressively thereinto.

13. The container assembly of claim 1 wherein an underside of the lid and/or an upper end of the container is provided with a sealing means which is engaged when the lid is mounted on the container to seal an opening thereat to the container.

14. The container assembly of claim 1 wherein temperature indicating patches are located on a sidewall of the container.

15. The container assembly of claim 1 wherein the lid further includes a septum permitting the addition or removal of the contents of the container by hypodermic syringe.

16. The container assembly of claim 1 including a diagnostic test strip within the container for detecting predetermined substances.

17. The container assembly of claim 1 wherein the container is nestable, having a base and sidewalls diverging upwardly and outwardly from the base to define an open top.

18. The container assembly of claim 1 wherein the lid includes an upper portion hingedly connected to a lower portion, the upper portion being movable between an open position and a closed position.

19. The container assembly of claim 18 wherein the lower portion includes a peel away cover portion which, when peeled away, provides access to the container when the lid is mounted thereto, the cover portion being covered by the upper portion when in the closed position.

20. The container assembly of claim 1 wherein the lid has a projection with a closure mounted at the projection to cover an opening to a passage through the projection.

21. The container assembly of claim 20 including a sealing element located under the closure for closing the passage to fluid flow.

22. The container assembly of claim 20 wherein the closure itself is tamper evident and the projection is formed to be upstanding from the lid.

23. The container assembly of claim 20 wherein the projection is centrally located in the lid.

24. The container assembly of claim 20 wherein the closure is a ring pull formation including a tab defined within the closure that has a frangible sideline extending from a non-frangible hinge to the closure, with the ring connected to the tab, and such that pulling on the ring at a predetermined force causes the frangible sideline to break, thus exposing the passage.

* * * * *